US009463490B2

(12) United States Patent
Damm

(10) Patent No.: US 9,463,490 B2
(45) Date of Patent: Oct. 11, 2016

(54) VIBRATION EXCITER, IN PARTICULAR FOR A CONSTRUCTION MACHINE

(71) Applicant: EURODRILL GmbH, Drolshagen (DE)

(72) Inventor: Horst Damm, Sprockhoevel (DE)

(73) Assignee: EURODRILL GmbH, Drolshagen (DE)

( * ) Notice: Subject to any disclaimer, the term of this patent is extended or adjusted under 35 U.S.C. 154(b) by 0 days.

(21) Appl. No.: 14/221,159

(22) Filed: Mar. 20, 2014

(65) Prior Publication Data

US 2014/0283633 A1 Sep. 25, 2014

(30) Foreign Application Priority Data

Mar. 20, 2013 (EP) ..... 13160158

(51) Int. Cl.
*B06B 1/16* (2006.01)

(52) U.S. Cl.
CPC ..... *B06B 1/16* (2013.01); *B06B 1/166* (2013.01); *Y10T 74/18552* (2015.01)

(58) Field of Classification Search
CPC ..... B06B 1/16; B06B 1/62; B06B 1/162; B06B 1/166; E02D 7/18; E02D 3/074; E21B 7/24; B25D 11/066; B25D 2717/0076
USPC ..... 74/61, 86, 87; 175/55; 173/49
See application file for complete search history.

(56) References Cited

U.S. PATENT DOCUMENTS 2,766,629 A * 10/1956 Booth ..... 74/61
2,897,734 A * 8/1959 Bodine, Jr. ..... E02D 3/074 173/185
3,145,831 A * 8/1964 Josef Roder et al. ..... 198/753
3,208,292 A 9/1965 Austin et al.
3,505,885 A * 4/1970 Waschulewski et al. ..... 74/61
3,564,932 A * 2/1971 Lebelle ..... 74/61
3,832,080 A * 8/1974 Stoecker ..... 404/133.1
4,050,527 A * 9/1977 Lebelle ..... 173/49
4,471,666 A * 9/1984 Unrath ..... B06B 1/166 173/49
4,793,196 A 12/1988 Davis et al.
4,928,551 A * 5/1990 Connelly et al. ..... 74/606 R
4,942,776 A 7/1990 Quirk et al.

(Continued)

FOREIGN PATENT DOCUMENTS

CN 1501845 A 6/2004
CN 101091948 A 12/2007

(Continued)

OTHER PUBLICATIONS

European Search Report; EP13160158; Nov. 19, 2013.

*Primary Examiner* — Victor MacArthur
*Assistant Examiner* — Jude Agendia
(74) *Attorney, Agent, or Firm* — Studebaker & Brackett PC

(57) ABSTRACT

The invention relates to a vibration exciter, in particular for a construction machine, having at least one rotatably supported unbalanced unit with at least one unbalanced element, a rotary drive, a gear arrangement with at least one gear wheel, wherein a rotation generated by the rotary drive can be transmitted by the gear arrangement to the at least one unbalanced unit, and a housing, in which the gear arrangement is accommodated. In accordance with the invention an energy-saving and low-maintenance arrangement is achieved in that by the gear arrangement an output shaft can be driven that extends out of the housing and in that the at least one unbalanced element is fixed outside of the housing on the output shaft.

11 Claims, 2 Drawing Sheets

(56) References Cited

U.S. PATENT DOCUMENTS

| | | | | |
|---|---|---|---|---|
| 5,123,292 | A * | 6/1992 | Woltering | 74/87 |
| 5,762,176 | A * | 6/1998 | Patterson | B65G 27/20 198/766 |
| 6,155,404 | A * | 12/2000 | Musschoot | B65G 27/20 198/753 |
| 6,601,695 | B1 * | 8/2003 | Rosenstrom | B06B 1/16 198/750.1 |
| 6,829,986 | B2 * | 12/2004 | Richter | 100/155 R |
| 7,117,758 | B2 * | 10/2006 | Riedl | 74/87 |
| 7,387,198 | B2 * | 6/2008 | Thomson | B65G 27/20 198/760 |
| 8,070,352 | B2 * | 12/2011 | Heichel et al. | 366/128 |
| 8,866,314 | B2 * | 10/2014 | Linevich | 290/1 C |
| 2004/0045877 | A1 | 3/2004 | Rubie et al. | |
| 2008/0156507 | A1 | 7/2008 | Nonaka et al. | |
| 2009/0173542 | A1 * | 7/2009 | Ibrahim et al. | 175/55 |

FOREIGN PATENT DOCUMENTS

| | | | |
|---|---|---|---|
| DE | 2945228 | A1 | 5/1981 |
| DE | 19608815 | C1 | 10/1997 |
| EP | 0824971 | B1 | 6/1999 |
| GB | 2318401 | B | 4/1998 |
| JP | 49-018280 | | 5/1974 |
| JP | 53-106069 | | 9/1978 |
| JP | 03-040330 | | 4/1991 |
| JP | 05-003271 | | 1/1993 |
| JP | H05-239831 | A | 9/1993 |
| JP | H10-43685 | A | 2/1998 |
| JP | 2002-097883 | A | 4/2002 |

* cited by examiner

VIBRATION EXCITER, IN PARTICULAR FOR A CONSTRUCTION MACHINE

BACKGROUND OF THE INVENTION (1) Field of the Invention

The invention relates to a vibration exciter, in particular for a construction machine, having at least one rotatably supported unbalanced unit with at least one unbalanced element, a rotary drive, a gear arrangement with at least one gear wheel, wherein a rotation generated by the rotary drive can be transmitted by means of the gear arrangement to the at least one unbalanced unit, and a housing, in which the gear arrangement is accommodated.

2) Description of Related Art

A vibration exciter of such type can be taken from EP 0 824 971 B1 for example. Such a vibration exciter, as provided for construction machines, especially for vibrators, has a central rotary drive which sets several unbalanced units into rotation through a toothed wheel arrangement. The unbalanced units each have an unbalanced element which is designed together with the toothed wheels as rotation elements. These are supported on their outside by way of roller bearings in a housing. As a result of the rotating unbalanced masses a selective generation of vibrations is rendered possible. Through an appropriate adjustment of the individual unbalanced units with the unbalanced elements the unbalances can add up or compensate one another.

Vibration exciters of this type are used, for example, in so-called vibrators for driving planks into loose soil.

Furthermore, vibration exciters for generating vibrations can also be employed in drilling devices, as can be gathered from DE 196 08 815 C1 for example. As an alternative or a complement to the rotational movement of a rotary drill drive the vibrations can bring about a significant improvement in the drilling progress.

In the known vibration exciters the unbalanced elements are accommodated together with the gear arrangement in a housing. Due to the fact that the gear wheels and unbalanced masses partially rotate at a high speed of some hundred up to several thousand revolutions per minute, the housing is filled with oil for lubrication.

SUMMARY OF THE INVENTION

The invention is based on the object to provide a vibration exciter which is of a simple and maintenance-friendly construction and permits an energy-saving operation.

The vibration exciter according to the invention is characterized in that by means of the gear arrangement an output shaft can be driven, which extends out of the housing, and in that the at least one unbalanced element is fixed outside of the housing on the output shaft.

A basic idea of the invention resides in the fact that the gear arrangement for driving the unbalanced units continues to be provided inside the housing, while the at least one unbalanced element is fixed outside the housing on an output shaft projecting from the housing. In this way, the housing can be of a small and cost-efficient design. Accordingly, the need for gear oil, with which the housing is to be filled, decreases.

Another positive aspect of the invention resides in the fact that the unbalanced elements located outside the housing are easily accessible. This greatly facilitates maintenance and exchange operations on the unbalanced elements. By relocating the unbalanced elements towards the outside of the housing the unbalanced elements are in addition no longer in contact with the gear oil. In particular, the unbalanced elements do not have to run through an oil sump, whereby the friction and thus the energy consumption of the entire vibration exciter are reduced.

Within the meaning of the invention the gear arrangement of the vibration exciter according to the invention can be a toothed-wheel gear, a friction wheel arrangement or also a chain gear or a belt transmission. Accordingly, the gear wheel is then designed as a toothed wheel, friction wheel, chain wheel or belt transmission wheel.

A preferred embodiment of the invention resides in the fact that at least one first unbalanced unit and at least one second unbalanced unit are provided for forming a pair of unbalanced units and in that the unbalanced units of a pair each have an output shaft which can be driven with a different direction of rotation.

As a result of the pairwise arrangement of unbalanced units that are driven with a different direction of rotation horizontal forces can be compensated in a preferred manner, while these add up or compensate each other in the vertical direction through an appropriate adjustment of unbalance.

A particularly advantageous embodiment of the invention from the point of view of stability resides in the fact that at least one output shaft of an unbalanced unit extends on both sides out of the housing and in that a first unbalanced element is arranged on a first end side of the output shaft and a second unbalanced element is arranged on an opposite lying second end side of the output shaft of the unbalanced unit. Thus, a symmetrical arrangement of the unbalanced elements of an unbalanced unit is present with respect to a center plane of the gear arrangement.

To generate large or strong vibrations provision is made in accordance with a further embodiment of the invention in that several pairs of unbalanced units are provided. The unbalanced units can be arranged on top of or next to each other.

For an especially compact construction of the vibration exciter a preferred embodiment resides in the fact that the unbalanced elements of one unbalanced unit are arranged offset to the unbalanced elements of another unbalanced unit. For instance the output shafts of two unbalanced units can be spaced slightly further than the radius of a disk-shaped unbalanced element, in which case a collision of the rotating disk-shaped unbalanced units is achieved through an axial offset of the unbalanced elements on the respective output shafts.

According to another preferred embodiment of the invention a high flexibility in the generation of vibrations is achieved in that at least one unbalanced element is supported in a releasable and exchangeable manner on the output shaft. The disk-shaped unbalanced element can be attached e.g. by means of a splined toothing to a free end side of the output shaft and fastened by a suitable securing means, such as a shaft nut or a radial splint. This securing or connecting means is easy to release so that the unbalanced element can be replaced by a larger or smaller unbalanced element or supplemented by further elements in order to thereby influence the type of vibration excited.

Furthermore, according to another embodiment of the invention it is preferred that for the lubrication of the gear arrangement the housing is filled with gear oil. The housing can be filled completely or by preference only partly with gear oil, in which case the lubrication of the upper parts of the gear arrangement is effected through spray-wetting.

A further preferred embodiment of the invention resides in the fact that an adjusting unit for adjusting the angular position of the unbalanced units to each other is provided. To this end the unbalanced elements can be of two-part design for example, wherein a twisting of the two parts can enhance or reduce an uneven mass distribution. In addition, by way of the adjusting unit with an adjusting wheel an unbalanced unit can also be adjusted in its angular position with respect to the other unbalanced units in order to influence the amplitude of vibration.

An advantageous embodiment of the invention furthermore resides in the fact that the rotation motor is flanged on the housing and a drive shaft of the rotation motor drives a drive pinion of the gear arrangement. The rotation motor is mounted outside of the housing so that it is easy to exchange and maintain.

Especially in the case of output shafts that extend on both sides out of the housing of the vibration exciter, it is preferred in accordance with the invention that each of the output shafts has a centrally located output gear wheel. As a result, a symmetrical and therefore gentle flow of forces is brought about. The output gear wheel can be formed integrally with the output shaft or mounted as a separate gear element, such as a gear rim, on the output shaft.

Moreover, according to an embodiment of the invention it is of advantage that the housing has a connecting means, with which the housing can be fastened on a working implement. In the simplest variant the connecting means can be a plain flange, with which the housing is fixed on a connecting point of a drilling device for example. The connecting means can also have damping elements so that vibrations are primarily transmitted into a specific direction whilst being dampened in other directions.

Furthermore, the invention relates to a construction machine which is characterized in that a previously described vibration exciter according to the invention is provided.

In accordance with the invention the construction machine can be designed as a drilling device or vibrator. In principle, however, other applications are also possible, such as in soil compactors or screen elements.

In the following the invention is described further by way of a preferred embodiment illustrated schematically in the drawings, wherein show:

DETAILED DESCRIPTION OF THE INVENTION

Figure 2:
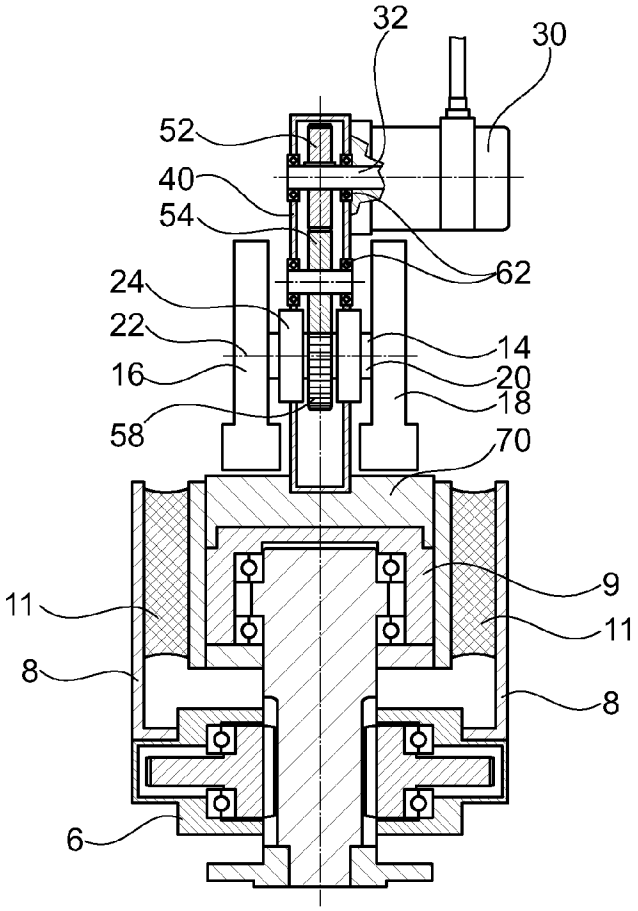
FIG. 2 a longitudinal section of the vibration exciter according to FIG. 1.

According to FIGS. 1 to 4 a vibration exciter 10 according to the invention, which can also be referred to as a vibration unit, has a small box-shaped housing 40, in which a gear arrangement 50 is provided. By way of a rotary drive 30, which is flanged on the outside of the housing 40 and the drive shaft 32 of which extends into the interior of the housing 40, a drive pinion 52 with an external toothing is set into rotation.

Figure 1:
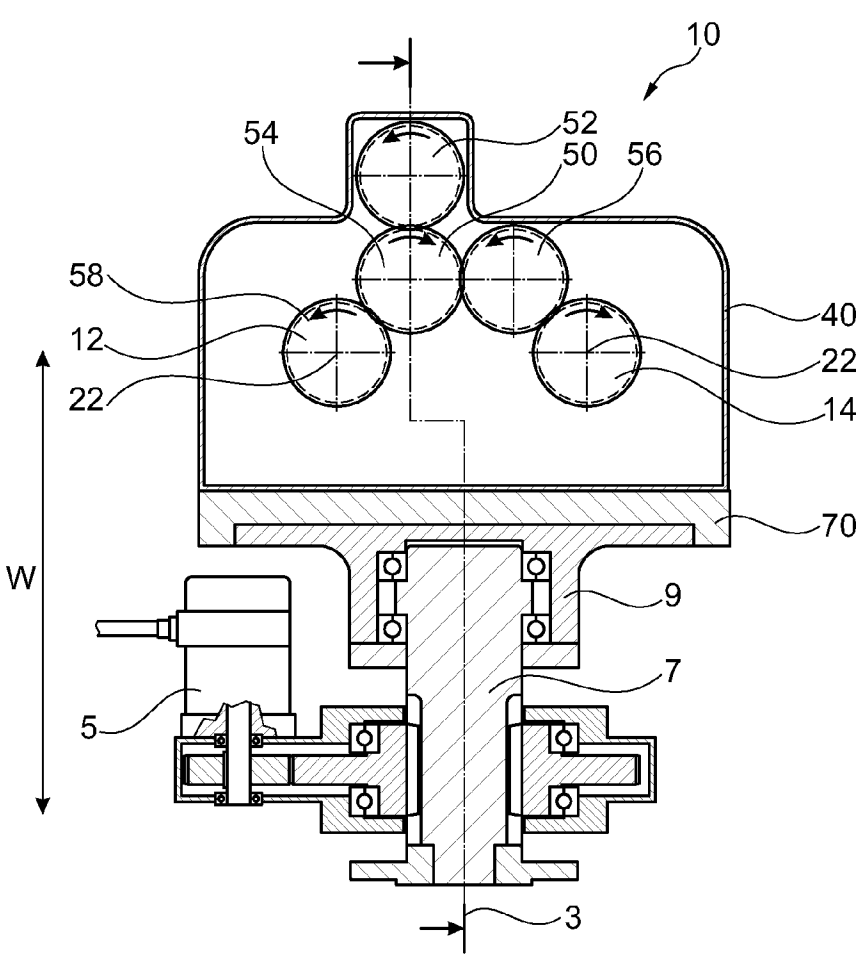
FIG. 1 a cross-sectional view of a vibration exciter according to the invention on a drill drive head.
Figure 3:
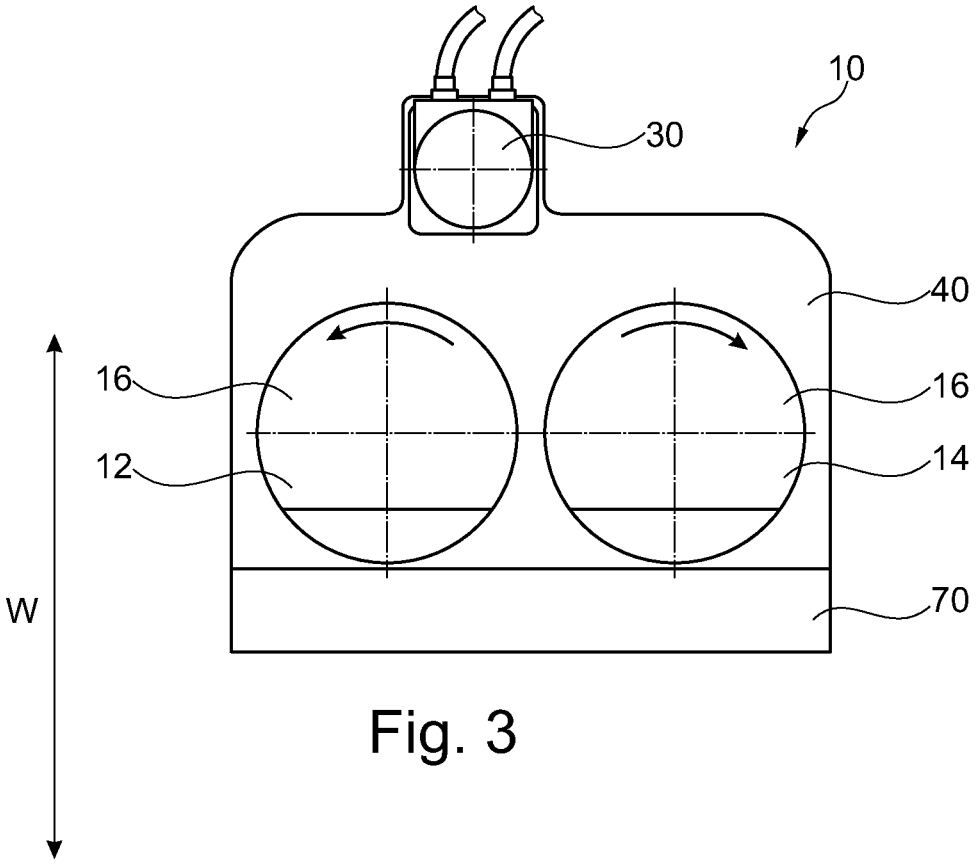
FIG. 3 a schematic side view of the vibration exciter of FIG. 1 but without drill drive head.
Figure 4:
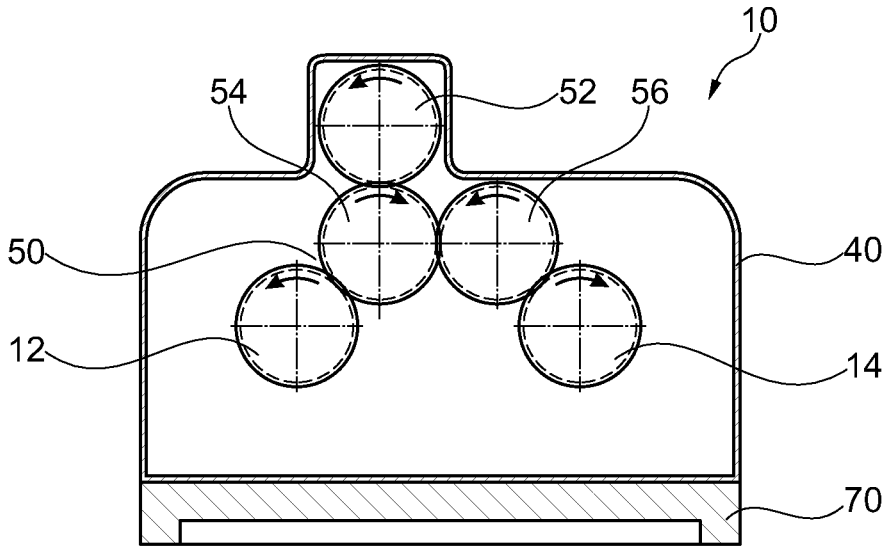
FIG. 4 a cross-sectional view of the vibration exciter of FIG. 3.

As can be taken from FIGS. 1 and 4 in particular, the drive pinion 52 initially drives an intermediate toothed wheel 54 with a corresponding external toothing. The intermediate toothed wheel 54 meshes, on the one hand, with an external toothing of a first output gear wheel 58 and in this way drives a first unbalanced unit 12. The first output gear wheel 58 is arranged centrally on an output shaft 20 which extends on both sides towards the outside of the plate-shaped housing 40, as can be gathered from FIG. 2. The output shaft 20 is rotatably supported on the housing 40 by way of two output shaft bearings 24, not shown in greater detail. The housing 40 is sealed off by sealing rings. On a first end side of the output shaft 20 a first disk-shaped unbalanced element 16 and on a second end side of the output shaft 20 a second disk-shaped unbalanced element 18 are releasably fixed.

On the other hand, the intermediate toothed wheel 54 also drives a reverse toothed wheel 56 with an external toothing. The reverse toothed wheel 56 meshes with a second output gear wheel 58 of a second output shaft 20 of a second unbalanced unit 14. The unbalanced unit 14 is designed identically to the previously described first unbalanced unit 12 and accordingly has a first unbalanced element 16 and a second unbalanced element 18 which are each arranged on an end side of a second output shaft 20, as becomes apparent from FIG. 2. However, by interposing the reverse toothed wheel 56 the output shaft 20 of the second unbalanced unit 14 rotates in the opposite direction with respect to the output shaft 20 of the first unbalanced unit 12 about the axis 22, as illustrated schematically in FIG. 1 by the rotation arrows. The axes 22 of the two output shafts 20 are arranged parallel to each other, just as the further axes of rotation of the gear wheels of the gear arrangement 50. Due to the rotating unbalanced elements 16, 18 the housing 40 and the entire arrangement is set into vibration, with the unbalanced masses being arranged such that a vibration amplitude is developed in a direction of application W which is shown schematically in FIGS. 1 and 3.

On an underside of the housing 40 a plate-shaped connecting means 70 can be arranged, with which the vibration exciter 10 can be releasably fixed on a working implement of a construction machine.

In FIGS. 1 and 2 such a working implement, namely a drilling device, more particularly an earth or rock drilling device, is depicted partially. For this purpose, the connecting means 70 is fastened on a flange-like bearing head 9, in which a drill drive shaft 7 is rotatably supported.

As illustrated in FIGS. 1 and 2, a rotational movement can be transmitted in a generally known manner by means of a drill drive 5 via a toothed wheel arrangement to the drill drive shaft 7 with a corresponding splined toothing. On the drill drive shaft 7 a drill rod, not illustrated in detail, can be flanged. In this arrangement, a rotational movement transmitted by the drill drive 5 can thus be superimposed by an axial vibrating movement of the vibration exciter 10.

The objective of this arrangement is to provide the vibration amplitude in the direction of application W as parallel as possible to the direction of a drilling axis 3. To avoid an unnecessary transmission of undesired transverse vibrations from the bearing head 9 to the housing of the drive arrangement of the drill drive 5 the bearing head 9 is supported by means of lateral supports 8 with respect to a drill drive housing 6, with damping elements 11 consisting of an elastic rubber material being arranged between the supports 8 and the bearing head 9.

The invention claimed is:

1. Vibration exciter for a construction machine, having at least two rotatably supported unbalanced units, each of said unbalanced units including a first unbalanced element and a second unbalanced element, a rotary drive, a gear arrangement with at least one gear wheel, wherein a rotation generated by the rotary drive can be transmitted by means of the gear arrangement to the at least two unbalanced units, a housing which is sealed-off and filled with gear oil for lubrication of the gear arrangement, and said housing having an upper part and a lower part, in which the gear arrangement is accommodated, a connecting element provided at the lower part of the housing, a flange bearing head fastened to the connecting element, a drill drive shaft rotatably supported by the flange bearing head and Wherein by means of the gear arrangement an output shaft can be driven, which extends out of the housing, the rotary drive is flanged on the upper part of the housing and is provided above the first and the second unbalanced elements and a drive shaft of the rotary drive drives a drive pinion of the gear arrangement and the drive pinion is arranged above the first and the second unbalanced elements and between the first and the second unbalanced elements in a lateral direction, and the first unbalanced element is arranged on a one end side of the output shaft and the second unbalanced element is arranged on an opposite end side of the output shaft, whereby each of the unbalanced elements is supported in a releasable and exchangeable manner on the output shaft.

2. Vibration exciter according to claim 1, wherein at least the first unbalanced unit and at least the second unbalanced unit are provided for forming a pair of unbalanced units and the pair of unbalanced units each have an output shaft which are driven with a different direction of rotation.

3. Vibration exciter according to claim 2, wherein several pairs of unbalanced units are provided.

4. Vibration exciter according to claim 1, wherein the unbalanced elements of one unbalanced unit are arranged offset to the unbalanced elements of another unbalanced unit.

5. Vibration exciter according to claim 1, wherein at least one of the unbalanced elements is supported in a releasable and exchangeable manner on the output shaft.

6. Vibration exciter according to claim 1, wherein each output shaft has a centrally located output gear wheel.

7. Vibration exciter according to claim 1, wherein the housing has a connecting means, with which the housing can be fastened on a working implement.

8. Construction machine, wherein a vibration exciter according to claim 1 is provided.

9. Construction machine according to claim 8, wherein it is designed as a drilling device or vibrator.

10. Construction machine according to claim 8, further comprising a drill drive which is provided with a drill drive housing, wherein the bearing head is supported by means of lateral supports with respect to the drill drive housing.

11. Construction machine according to claim 10, wherein the connecting element is provided with damping elements arranged between the respective lateral supports and the bearing head so that vibrations are primarily transmitted into a specific direction whilst damping the transmission of the vibrations in other direction.

* * * * *